US006066027A

United States Patent [19]

Fildan

[11] Patent Number: 6,066,027

[45] **Date of Patent: *May 23, 2000**

[54] NEEDLE WIRE FOR AN UNDERWIRE BRASSIERE

[76] Inventor: Gerhard Fildan, Dr. Körner Str. 64, A-2521 Trumau, Austria

[ * ] Notice: This patent is subject to a terminal disclaimer.

[21] Appl. No.: 09/266,132

[22] Filed: Mar. 10, 1999

Related U.S. Application Data

[63] Continuation-in-part of application No. 08/855,682, May 14, 1997, Pat. No. 5,951,365.

[51] Int. Cl.[7] ..... A41C 3/10; A41C 3/12

[52] U.S. Cl. ..... 450/52; 450/41; 450/47; 450/49; 450/51

[58] Field of Search ..... 450/41–43, 45–52, 450/92, 93; 2/255–260, 260.1, 261, 264

[56] References Cited

U.S. PATENT DOCUMENTS

| | | | |
|---|---|---|---|
| Re. 22,771 | 7/1946 | Licht | 450/41 |
| 3,747,606 | 7/1973 | Tareau | 450/41 |
| 3,799,175 | 3/1974 | Rowell | 450/41 |
| 4,275,740 | 6/1981 | Weston | 450/41 |
| 5,141,470 | 8/1992 | Morgan et al. | 450/52 |
| 5,219,311 | 6/1993 | Fildan | 450/41 |
| 5,401,203 | 3/1995 | Fildan | 450/41 |
| 5,472,366 | 12/1995 | Moore | 450/41 |
| 5,951,365 | 9/1999 | Fildan | 450/41 |

*Primary Examiner*—Gloria M. Hale
*Attorney, Agent, or Firm*—Herbert Dubno

[57] ABSTRACT

A brassiere of the underwire type has a "U" shaped stitched sheath beneath each cup of an open "U" configuration and into which a "C" shaped underwire with inwardly bent ends is inserted so that, in spite of the fact that the respective underwire assumes a "U" configuration of the sheath, the springy ends of the underwire tend to produce a roundness illusion of the cup. The wire has a circular cross section with a diameter of 1.5 to 2.5 mm and is composed of polyamide so as to be flexible in all directions and has flanges at its ends through one of which the wire is stitched to retain it in the respective sheath.

9 Claims, 3 Drawing Sheets

FIG. 1
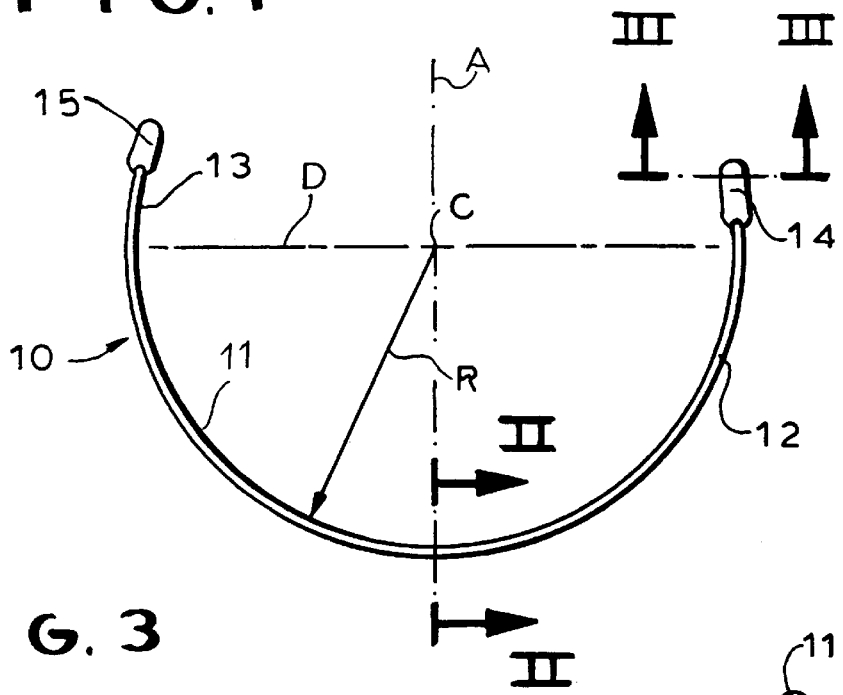
FIG. 3
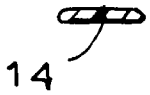
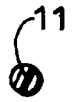
FIG. 2
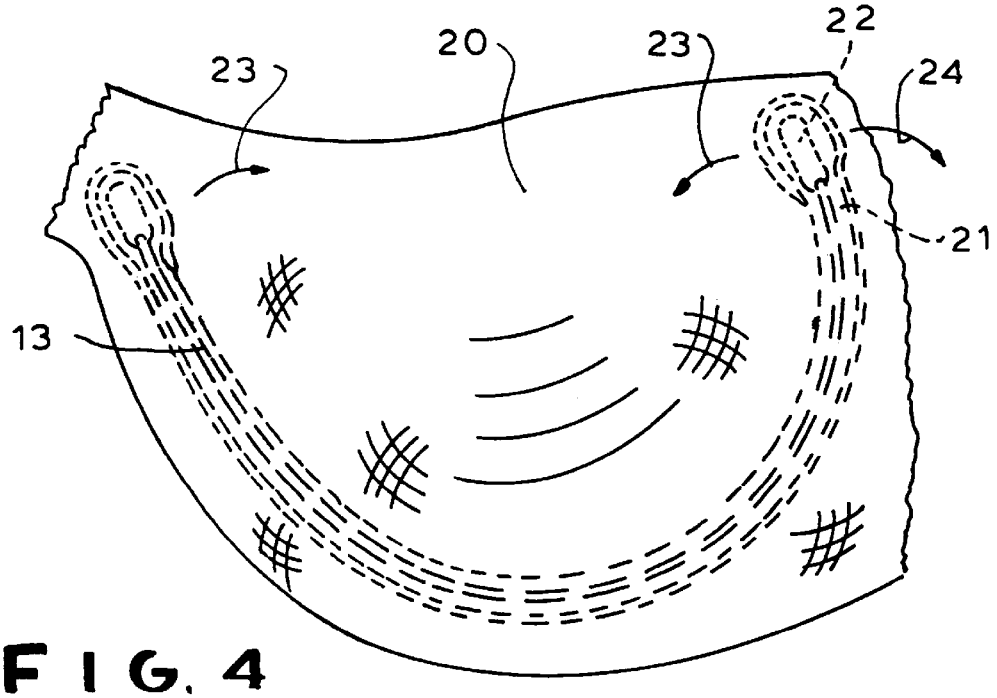
FIG. 4

NEEDLE WIRE FOR AN UNDERWIRE BRASSIERE

CROSS REFERENCE TO RELATED APPLICATION

This application is a continuation-in-part of application Ser. No. 08/855682 filed May 14, 1997 now U.S. Pat. No. 5,951,365.

FIELD OF THE INVENTION

My present invention relates to a needle wire for an underwire brassiere.

BACKGROUND OF THE INVENTION

In underwire brassieres it is the common practice to provide a tubular pocket or sheath below a brassiere cup in which a "wire", frequently referred to as an "underwire" is received to assist in maintaining the shape of the cup.

In early versions of the underwire brassiere, the wire itself was of circular cross section and composed of metal with a high degree of stiffness, thereby imparting significant rigidity to the brassiere. Because that wire tended to pierce through the fabric of the brassiere, it could pose a danger to the wearer and complicated the laundering of the brassiere. Insertion of he wire into the tubular sheath of the cup also posed a problem because of the high rigidity of the wire.

As a consequence, plastic wires were developed as brassiere underwires with the advantage that the flexibility of the underwire was improved. These underwires could have a flattened cross section to enhance stiffness in the wire plane while affording some flexibility transversely thereto. It has also been proposed to stitch the plastic wire in place through at least one end of the wires, usually the end of the underwire located at the cleft in the brassiere between the two cups, while the opposite end of the wire, toward the outside of the brassiere tended to move free in the tubular sheath or pocket. Even with such plastic underwires, there was considerable stiffness which could lead to discomforture of the wearer.

There have been proposals for underwires which are not preformed and which are so flexible that they assume the shape of the sheath or pocket without contributing any preform to the shape. These wires have the advantage that the brassiere cup can have considerable flexibility and thus can be more comfortable and can be washed without any danger that the wire will pierce through the fabric and snag on other garments during the laundering process. However, such totally flexible wires do not significantly contribute to shaping of the cup and do not satisfy the need for imparting a certain shape to the brassiere cup both in use and when the brassiere is on a hanger to satisfy the wearer.

Mention may also be made of the fact that heretofore, with relatively stiff underwires, the brassiere designers were compelled to have the underwire fabricated to precisely fit the sheath or tube formed in the brassiere so as to avoid damage to the fabric by the wire with time. The need to have specially designed wires to fit any particular brassiere design greatly complicated brassiere manufacture. Of course, when totally flexible wires were used, this problem did not arise, but the brassiere designer was compelled to accept the fact that the underwire could not contribute adequately to the desired configuration of the brassiere.

Finally, it may be noted that the preformed underwires heretofore marketed and used commercially and successfully have had the configuration of a "U" or an arc segment with one or more centers of curvature and ends which extend parallel to one another or diverge with respect to one another so as to constitute generally open arcs. This configuration was vital for stiff wires so as to prevent pinching of the breast when received in the cup and to allow mobility of the brassiere on fitting and outer wearing.

OBJECTS OF THE INVENTION

It is the principal object of the present invention to provide an improved needle wire for use as a brassiere underwire, whereby drawbacks of earlier systems can be obviated.

A more specific object of the invention is to provide an improved underwire for a brassiere cup which can be more easily incorporated into the brassiere, will not interfere with the flexibility of the brassiere during use on or laundering, will not pierce through the fabric of the brassiere, and yet will assist in imparting a desired configuration to the cup when the brassiere is worn and when the brassiere is displayed.

Another object of this invention is to provide an improved method of making a brassiere and, in particular, of providing an underwire brassiere cup so that it retains its shape when it is not being worn, but provides shape support in an improved manner by comparison with other underwires, without pinching or otherwise distressing the wearer.

Yet another object of this invention is to provide a method of fabricating an underwire brassiere which eliminates the need for precisely matching the configuration of the underwire sheath to the shape of the underwire and vice versa.

SUMMARY OF THE INVENTION

These objects and others which will become apparent hereinafter are attained, in accordance with the invention, in an underwire for a brassiere cup which can be referred to as a "needle" wire because it will have a relatively small diameter, usually 1.5 to 2.5 mm and a circular cross section enabling it to flex in all directions. Rather than having the configuration of an open "U" or a "U" with parallel shanks, as has been the case with most preformed underwires, the needle wire of the present invention, has inwardly-turned ends, i.e. is generally "C" shaped.

I have found, quite surprisingly, that when a needle wire of this diameter is composed of a shape-retentive plastic such as a polyamide (nylon), the inwardly-turned ends do not contribute to pinching of the breast of the wearer, but rather contribute a springiness to the brassiere which maintains the cup shape without any springiness, especially when that wire is incorporated in a sheath or stitched tube of the brassiere which originally has a more open "U" shape. As a consequence, the underwire is not matched to the shape of the tubular sheath but rather a tubular sheath can be stitched in the garment which is of an open "U" shape and the preformed "C" shaped underwire can be inserted into this sheath so as to impart a defined springiness to the lower portion of the brassiere cup which greatly improves its appearance upon display from a hanger, for example, and greatly improves its fit to the wearer, while avoiding the pinching action which might otherwise be expected of inwardly-turned ends on the underwear.

According to an improved feature of the invention each of the ends of the polyamide underwire is formed with a flattened flange or lug, the flange or lug at the inner end of the underwire, i.e. the end of the underwire located toward the midpoint or cleft of the brassiere being larger (e.g. longer) than the flange at the outer end of the wire so that the two ends can be readily distinguished. The inner end is usually stitched through to anchor it in the sheath.

Frequently the underwire is positioned in the sheath and beneath the cup in an asymmetrical manner, i.e. with a shorter side of the wire at the inner portion of the cup and a longer side of the wire toward the outer part of the cup. The longer tab or flange at the inner side allows the brassiere maker to distinguish the shorter side of the underwire more readily from the longer side and thus prevents insertion of the underwire in the wrong direction into the sheath.

According to a feature of the invention, the underwire should have an arc length in excess of 180° and preferably may have an arc length of about 210° to 270°, with a single center of curvature for at least 180° and the underwire can then be referred to as a full radius underwire. Alternatively but less preferred are underwires which may have several centers of curvature and radii of curvature over 180°.

The brassiere fabricated with the underwires of the invention can be referred to as an "illusion" brassiere, since the preformed underwire has a certain springiness contributed by its inwardly bent ends which contribute to a well-defined rounded. shape of the cup when the wire is incorporated into a sheath having an open-U configuration. Thus, when the brassiere is worn, the inwardly-bent ends do not adversely affect the wearing characteristics and comfort because of the high flexibility of the needle wire although the appearance of the brassiere prior to use conveys the impression of a stiffer definition of the garment.

The "C" shape can be relatively shallow as shown in FIG. 1 wherein the ends of the wire extend beyond the axis of greatest diameter only to a relatively limited extent, or relatively deep, wherein the inwardly turned ends of the wire are relatively long, i.e. the overall depth of the C-shaped wire is in excess of twice the depth of the maximum diameter portion.

In either case, the C-shaped wire is preferably symmetrical about an axis perpendicular to the maximum diameter at the center of curvature thereof.

In the fabrication of the brassiere, the needle wire is made with its inwardly-turned ends as described, but the stitched tubular sheath is provided with an open "U" configuration. That wire is inserted into the tubular sheath and stitched only at its inner flange to the fabric to anchor the underwire in place. The result is a highly flexible brassiere which can flex uniformly in all directions but which, when hung, has a certain springiness in its support by the underwire so that the cup appearance is greatly improved by comparison with earlier systems.

BRIEF DESCRIPTION OF THE DRAWING

The above and other objects, features, and advantages will become more readily apparent from the following description, reference being made to the accompanying drawing in which:

FIG. 1 is an elevational view of a needle wire for use as an underwire for a brassiere in accordance with the invention;

FIG. 2 is a section taken along line II—II of FIG. 1;

FIG. 3 is a section taken along line III—III of FIG. 1;

FIG. 4 is an elevational view illustrating the configuration of the wire after it has been inserted into the stitched sheath of a brassiere cup;

SPECIFIC DESCRIPTION

Figure 5:
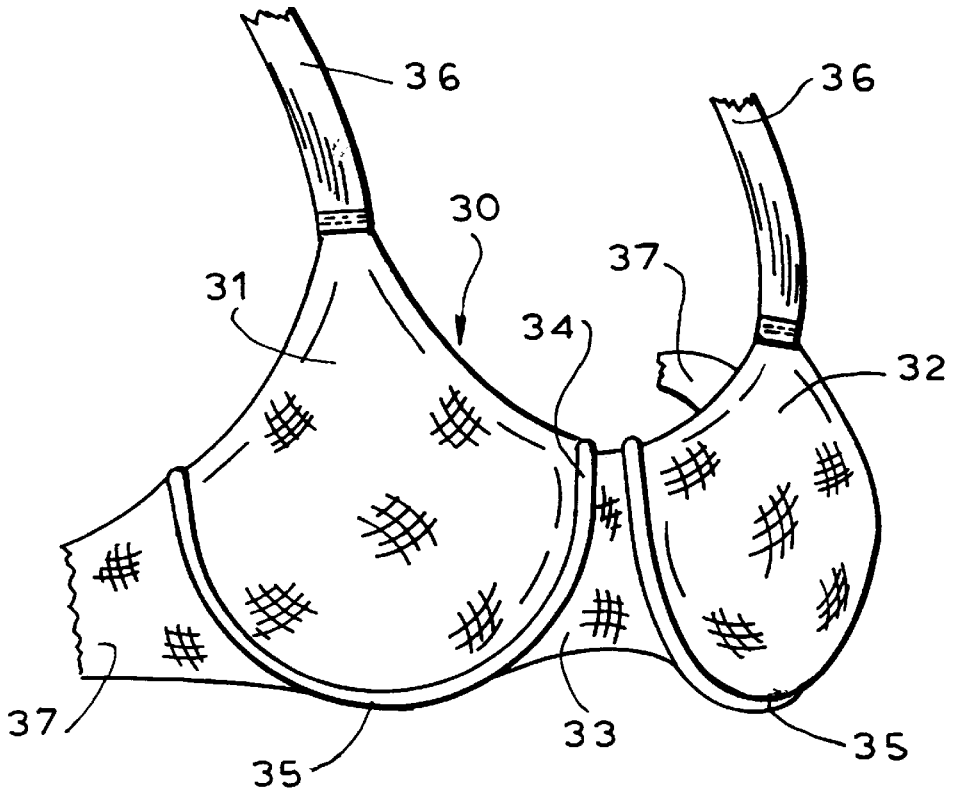
FIG. 5 is a partial perspective view of a brassiere provided with cups in accordance with the invention.

The needle wire of the illusion brassiere of the invention has been shown at 10 in FIG. 1 and comprises a one-piece or unitary polyamide (nylon) wire portion 11 of circular configuration and shown in FIG. 2 with a diameter of 1.5 to 2.5 mm.

The wire 11 is generally "C" shaped and has inwardly-turned ends 12 and 13 which are springy and can be deflected outwardly. Over an arcuate extent of at least 180°, the wire 11 has a single center of curvature "C" and a single radius R in the preferred embodiment of the invention.

As is also visible from FIG. 1, one of the ends (13) is longer than the other end (12) and the shorter end is provided with a relatively large flange 14 while the longer end has a relatively small flange 15 formed by flattening the wire as can be seen from FIG. 3. The longer or larger flange allows the brassiere maker to recognize immediately which of the sides of the wire is shorter and thus which should be located at the midregion of the brassiere when the brassiere is being manufactured.

The embodiment shown in FIG. 1 is also generally symmetrical with respect to an axis A toward which the ends 12 and 13 turn inwardly beyond the maximum diameter axis D.

According to the invention, a brassiere cup 20, formed from fabric, has stitched along the underside of the cup, a tubular sheath 21 in which the underwire 10 is received. The flange 14 at the midregion of the brassiere is stitched at 22 into the cup so that its end of the underwire is held firmly.

As FIG. 4 makes clear, the sheath 21 is not generally "C" shaped with inwardly-turned ends as is the underwire 10, but rather the sheath has a configuration of a "U" whose ends diverge from one another. When the underwire 10 is inserted into this sheath, however, it assumes the shape of the sheath, especially when the brassiere is worn, the springy ends of the underwire tending to generate slight forces in the direction of arrows 23 and 24 when the brassiere is hung from a hanger so as to impart a more rounded cup shape to the brassiere cups and thereby improve the aesthetics of the brassiere.

In the brassiere 30 shown in FIG. 5, each of the two cups 31 and 32 is connected at the midregion 33 and has a longer end 34 of the respective tubular sheath 35 at this region. Underwires such as that shown at 10 in FIGS. 1–4 are stitched at the midregion in the respective sheath which is disposed beneath the cup. The brassiere has the usual shoulder straps 36 and a back strap 37, the latter being connected to the outer sides of the cups in the region of the outer sides of the respective tubular sheath.

The brassiere is manufactured in the manner described, i.e. by formation of cups and the stitched sheaths beneath the cups, whereupon the preshaped underwires are inserted into the sheaths to assume the configuration thereof. The larger and longer flange is stitched to the cup to hold it in place.

Figure 6:
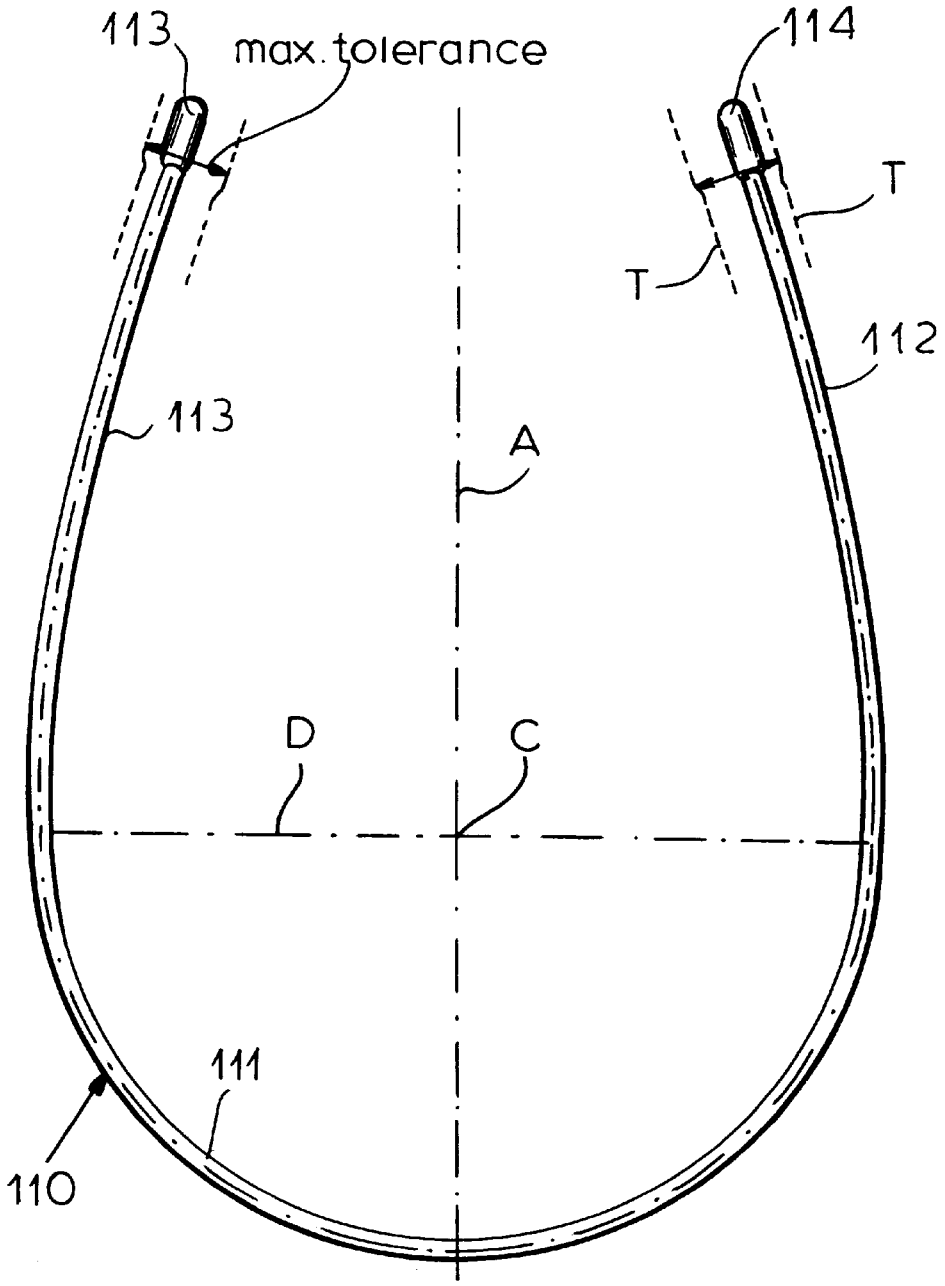
FIG. 6 is an elevational view of another needle wire for use as an underwire for a brassiere in accordance with the invention.

The wire can also have a configuration as shown in FIG. 6 for the wire 110 which differs from the wire 10 by being a deeper version of the "C" shape. The bite 111 is here circular and extends over 180° with a center "C" as has been described and the wire has an axis symmmetry A perpendicular to the maximum diameter axis D beyond which the ends 112 and 113 are turned inwardly. The ends are formed with stitching flanges 113 and 114 as described in the embodiment of FIG. 1. Dimensionally, the sewing flange 13, 14 or 113, 114 may have a thickness of say 0.7 mm ±0.10 mm, a width of the sewing flange of 3.00 mm ±0.15 mm and a length which can be varied as already noted but can be 9.30 mm ±0.15 mm. The diameter of the wire can be 2.20 mm ±0.15 mm and the stretched length can vary depending upon the size of the brassiere but can be in a specific case 352 mm ±2 mm (including the sewing flanges). The inwardly turned ends can be turned inwardly to a greater or lesser extent as represented by the tolerance lines shown.

I claim:

1. An underwire for a brassiere cup comprising a preformed generally C-shaped wire unitarily composed of a resilient synthetic resin with a circular cross section and inwardly turned spring ends each formed with a flange extending from one of said ends.

2. The underwire defined in claim 1 wherein said wire is composed of a polyamide.

3. The underwire defined in claim 2 wherein said wire has a diameter of said circular cross section of about 1.5 mm to 2.5 mm.

4. The underwire defined in claim 3 wherein one of said flanges is larger than the other of said flanges.

5. The underwire defined in claim 4 wherein said wire has one side shorter than another side thereof, said one of said flanges being on said shorter side.

6. The underwire defined in claim 5 wherein said wire has a single radius of curvature over an angular extent of at least 180°.

7. The underwire defined in claim 1 which is substantially symmetrical about an axis perpendicular to an axis of maximum diameter of the wire.

8. The underwire defined in claim 1 wherein said wire has a semicircular portion and said ends extend beyond said semicircular portion so that said perpendicular portion makes up most of the depth of the C-shaped wire.

9. The underwire defined in claim 1 wherein said wire has a semicircular portion and said ends extend beyond said semicircular portion so that said perpendicular portion makes up less than half the depth of said C-shaped wire.

* * * * *